US005178300A

United States Patent [19]

Haviv et al.

[11] Patent Number: 5,178,300

[45] Date of Patent: Jan. 12, 1993

[54] FLUID DISPENSING UNIT WITH ONE-WAY VALVE OUTFLOW

[76] Inventors: Shlomo Haviv, 3750 Hudson Manor Ter., New York, N.Y. 10463; Michael Hamilton, 5115 Fulton Ave., Sherman Oaks, Calif. 91423

[21] Appl. No.: 534,683

[22] Filed: Jun. 6, 1990

[51] Int. Cl.[5] ..... B65D 35/28

[52] U.S. Cl. ..... 222/95; 222/105; 222/207; 222/209; 222/212; 222/387; 222/494

[58] Field of Search ..... 222/94, 95, 96, 105, 222/326, 494, 206, 212, 215, 387, 207, 209

[56] References Cited

U.S. PATENT DOCUMENTS

| | | | |
|---|---|---|---|
| 2,728,494 | 12/1955 | Hobson | 222/386.5 |
| 2,898,007 | 8/1959 | Gassaway | 222/387 |
| 3,768,704 | 10/1973 | Béguin | 222/207 |
| 3,938,706 | 2/1976 | Cohen | 222/105 |
| 4,154,371 | 5/1979 | Kolaczinski et al. | 222/212 |
| 4,457,454 | 7/1984 | Meshberg | 222/209 |
| 4,469,250 | 9/1984 | Evezick | 222/95 |
| 4,533,069 | 8/1985 | Drobish | 222/209 |
| 4,696,415 | 9/1987 | Meshberg | 222/207 |
| 4,763,815 | 8/1988 | Von Schuckmann et al. | 222/105 |
| 4,776,496 | 10/1988 | Battegazzore | 222/387 |
| 4,830,228 | 5/1989 | Fillmore | 222/387 |
| 4,846,810 | 7/1989 | Gerber | 222/212 |
| 4,909,416 | 3/1990 | Evezich | 222/209 |
| 5,033,647 | 7/1991 | Smith et al. | 222/212 |

FOREIGN PATENT DOCUMENTS

| | | | |
|---|---|---|---|
| 2083142 | 3/1982 | United Kingdom | 222/209 |
| 8907084 | 8/1989 | World Int. Prop. O. | 222/209 |

*Primary Examiner*—Andres Kashnikow
*Assistant Examiner*—Kenneth Bomberg

[57] ABSTRACT

A fluid dispensing unit includes a hollow support with a reservoir or container located within the support. The container has a one-way valve at its outlet for dispensing fluid while preventing any flow of contaminants back into the container. As fluid is dispensed, the container can be collapsed to assure complete evacuation of the fluid.

18 Claims, 4 Drawing Sheets

FLUID DISPENSING UNIT WITH ONE-WAY VALVE OUTFLOW

BACKGROUND OF THE INVENTION

The present invention is directed to a closed system for dispensing a fluid from a container. A one-way valve is located at the outlet of the system affording flow out of the container while preventing any backflow of contaminants into it. Initially, the container is filled with a fluid free of air or any other gases. The one-way valve maintains the integrity of the fluid throughout its useful life even over extended time periods. The system could be used for dispensing metered amounts of the fluid.

In U.S. Pat. No. 5,846,810, a valve, hereinafter called the ReSeal valve, is disclosed for affording one-way flow out of a container while preventing any backflow which might contain contaminants. Contaminants from outside the valve may be microganisms, atmospheric gases, moisture, dust and the like. In dispensing various fluids, such as drugs, pharmaceuticals, health care products, cosmetics, liquid foodstuffs, beverages and the like, it is important to maintain the sterility of the fluid, particularly if it is not used all at one time. The fluid can have a high or low viscosity and may be a liquid, suspension, cream, lotion, gel or the like.

If the cost of the fluid to be dispensed is high, it is important to be able to dispense substantially all of the fluid. Maintaining a closed system for dispensing the fluid and, at the same time dispensing all of the fluid, can present problems.

SUMMARY OF THE INVENTION

Therefore, it is the primary object of the present invention to provide a closed system for dispensing fluid where the fluid is maintained free of any contamination, without the use of preservatives. Preservatives may adversely affect the useful life of the fluid or reduce its effectiveness. In addition, the fluid can be substantially completely dispensed in an effective and economically feasible manner.

The dispensing system embodying the present invention includes a flexible collapsible reservoir or container, a support structure at least laterally enclosing the container, and a one-way valve, such as the ReSeal valve, connected to the container for dispensing fluid and preventing backflow of any contaminants into the container during the dispensing operation. A one-way valve not insuring backflow prevention would not be effective in the present invention. Valves capable of blocking all backflow into the container could be used instead of the ReSeal valve.

The collapsible reservoir or container can be in a variety of forms, such as a flexible bag, a bellows-like container, or some other form which permits complete dispensing of the fluid. If a bag is used, preferably it is formed of an impermeable material. The material of the bag is usually determined by the fluid being dispensed. To assure sterility of the fluid, the bag must be constructed so that air, other gases, oils, moisture or the like cannot flow or pass through it and mix with the fluid. Under certain circumstances, it may be necessary to prevent light from entering into the container. The material forming the bag may include a foil barrier layer sandwiched between other layers, such as of plastics material, to assure the impermeability of the bag and to block light.

To assure that the container is completely emptied, a piston or similar member can be used in combination with the container. The container is enclosed within a support structure which can be a closed member or it can be open at least at one end. An important feature is that at least a part of the support structure can breathe for maintaining atmospheric pressure in contact with the piston. In one embodiment, the piston is located inside the container or secured to the base portion of the container within the support structure. As the fluid is dispensed out of the container, since the container holds no air, the atmospheric pressure acting on the piston moves the piston within the support structure toward the outlet. As the contents of the container are gradually dispensed, the piston moves toward the outlet causing the container to collapse and assuring that substantially all of its contents are dispensed.

In another embodiment, the piston can be located inside the bag so that the atmospheric pressure acting on the piston moves it through the bag toward the outlet for providing the desired discharge of the fluid. If the support is a closed structure, then it must be possible for atmospheric air to enter into at least the base of the structure to act on the piston. If the piston forms a seal with the inside of the support, the air will not enter between the bag or container in the support. As the bag is emptied, the piston will ride inside the support collapsing the bag as it moves toward the fluid outlet.

The piston can be located outside the bag, inside the bag or attached to the bag forming its base. As the contents are dispensed, the piston moves towards the valve and may carry the empty part of the bag along behind it.

In still another embodiment, the container as a flexible bag is placed within the support structure and atmospheric pressure acting on the bag causes it to collapse as its contents are dispensed. To avoid any blockage of the outlet from the bag, it may be attached to the inside of the support at one or more positions.

The support is formed of a rigid material and can in combination with the membrane completely enclose the container. Alternately, the support can be open at its bottom. If the bottom is closed, the support must have an opening to permit its interior to breathe so that atmospheric pressure can act on the collapsible container as it is emptied.

The fluid is dispensed by providing a pressing or pressurizing action on the container so that the fluid flows out through the one-way valve. The pressing action can be afforded by an elastic membrane positioned on and closing one end of the support and acting directly on the container. The valve can be incorporated into the membrane so that the two move as a unit. By depressing the membrane against the bag, its contents located between the membrane and piston are gradually dispensed. The amount dispensed is determined by the extent to which the membrane is depressed. Accordingly, the maximum amount that can be dispensed is determined by the maximum depression of the membrane. By releasing the pressure or force acting on the membrane, its self-restoring memory creates a low pressure within the bag less than the ambient pressure whereby the piston moves towards the membrane. The volume of the contents within the bag is reduced in direct proportion to the volume of fluid dispensed.

A spring can be used in combination with the membrane to enhance its self-restoring action.

In place of the membrane a pump can be attached to the valve to afford the flow of fluid out of the container. The pump can be a bellows like member.

In a further embodiment, the piston can be annular with sawtooth prongs in its opening. A rod within the container or bag passes through the opening. As the fluid is dispensed, the piston rides up on the rod toward the valve.

The fluid can be dispensed in a variety of forms, for instance, drops, a spray, a mist, or a continuous stream. The form of the dispensed fluid is determined by the shape of the valve outlet.

The fluid to be dispensed is introduced into the container in a sterile condition. Such introduction can be effected through the dispensing valve or through a sealable opening in the container or through the piston associated with the container.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

BRIEF DESCRIPTION OF THE DRAWINGS

In the drawings:

FIGS. 7, 8, 9 and 10 are sectional views of the device illustrating different embodiments of the piston and the

DETAILED DESCRIPTION OF THE INVENTION

Figure 1:
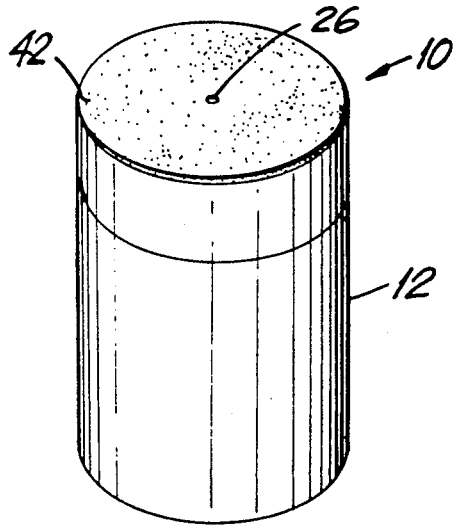
FIG. 1 is a perspective view of a fluid dispensing device embodying the present invention.
Figure 3:
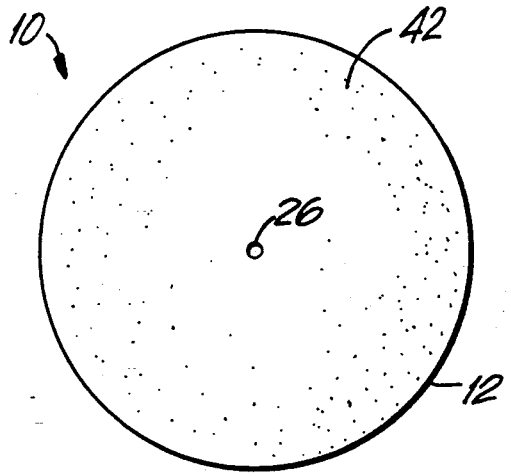
FIG. 3 is a plan view of the device shown in FIG. 1.
Figure 2:
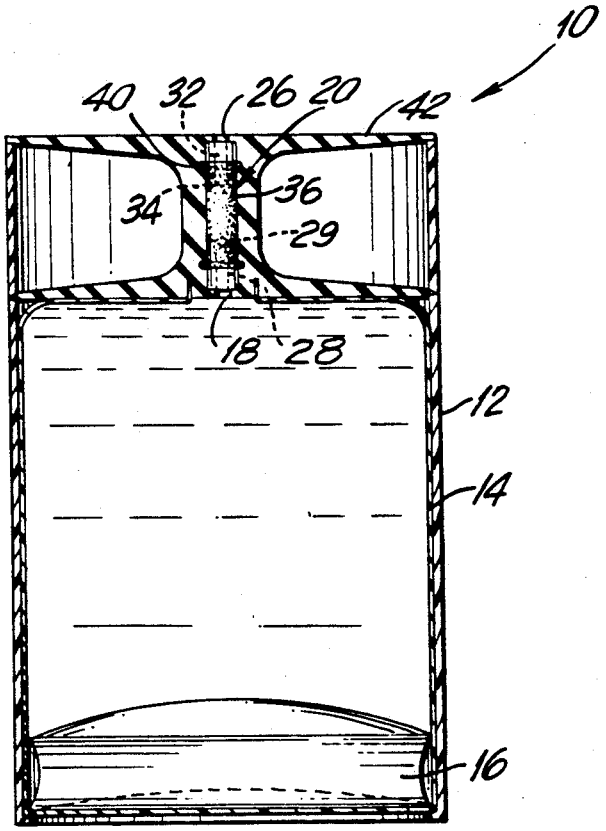
FIG. 2 is a sectional view of the device shown in FIG. 1.
Figure 4:
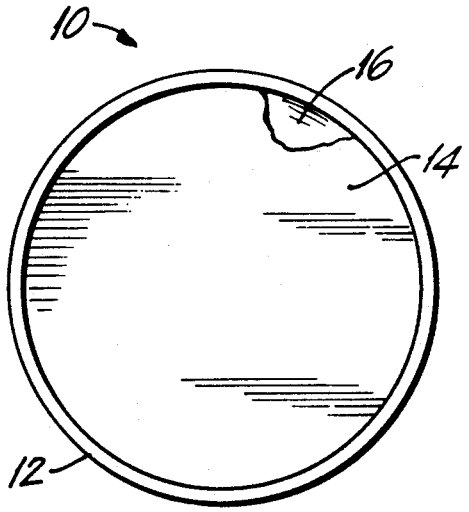
FIG. 4 is a bottom view.

In FIG. 1, a dispensing device 10 is illustrated. The device includes a cylindrically-shaped support 12. As illustrated in FIG. 2, a reservoir or container 14 is located within the support 12. The container 14 in the form of a flexible bag is collapsible so that substantially all of its contents can be dispensed. In FIG. 2, a piston 16 is shown within the container. Initially, the container 14 is completely filled with fluid so that it contains no air or other gases. The purpose of the piston 16 is to ride upwardly inside the bag displacing its contents out of the device 10. The fluid can be filled into the container 14 through the fluid outlet or through a sealable opening located in the container 14.

Figure 6:
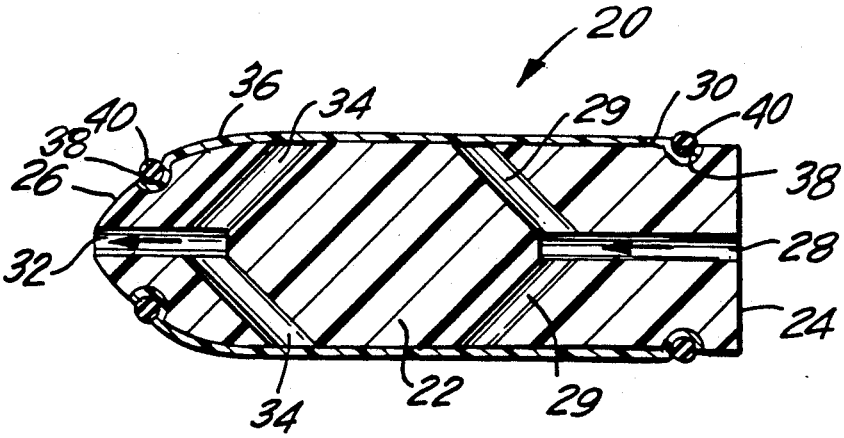
FIG.6 PRIOR ART
FIG. 6 is a sectional view on an enlarged scale of a valve for use at the outlet from the fluid dispensing device of the different embodiments.

At its upper end, the container 14 has an outlet 18 through which the fluid flows into a one-way valve 20, such as the ReSeal valve shown in FIG. 6. As explained in U.S. Pat. No. 4,846,810, the valve 20 is intended to maintain the sterility of the fluid contents in the container 14.

Figure 8:
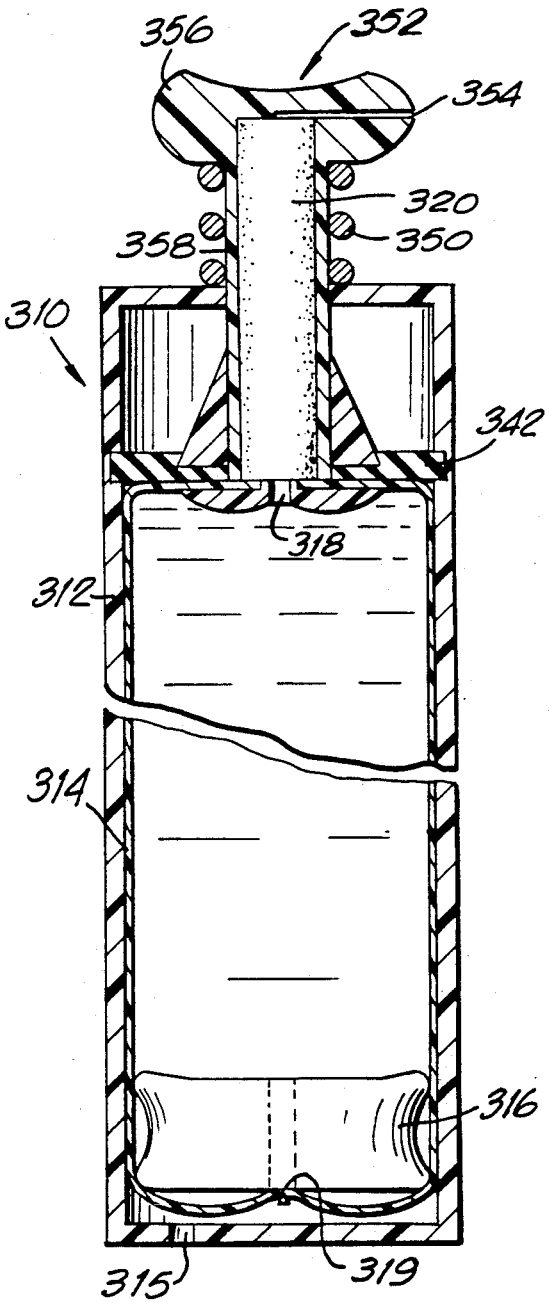

In FIG. 6, the one-way valve 20 is shown in detail. The one-way valve 20 comprises an elongated valve body 22, with an inlet end 24, and an outlet end 26. The inlet end 24 has a first outlet duct 28 which is located at the outlet 18 of the container 14. The first outlet duct 28 extends first in the elongated direction of the valve body 22 and then divides into at least two angularly disposed branch ducts 29 terminating at the outside surface 30 of the valve body 22. Toward the outlet end 26, there is a second outlet duct 32. The second outlet duct 32 is in general alignment with the first outlet duct 28. The second outlet duct opens from the valve body 22 at the outlet end 26. Spaced from the outlet end 26, the second outlet duct divides into the two branch ducts 34 open through the valve body surface 30. A flexible membrane 36 tightly encloses the valve body 22 from a location adjacent the inlet end 24 to a location adjacent the outlet end 26. As shown in FIG. 8, the membrane 36 is held in sealed contact with recesses 38 in the valve body by means of O-rings 40.

When pressure is applied to the container 14, the fluid in it is forced out through the first outlet duct 28 and through the first branch ducts 29, causing the flexible membrane 36 to expand outwardly from the valve body 22. The fluid flows between the outside surface 30 of the valve body 22 and the inside surface of the flexible membrane 36 from the first branch ducts 29 to the second branch ducts 34 and then out through the second outlet duct 32. The flexible membrane 36 tightly closes the first and second branch outlet ducts 29, 34 when the fluid does not force the flexible membrane radially outwardly. As a consequence, after the fluid passes into the second branch ducts 34, the membrane seals the openings into the second branch ducts and the first branch ducts preventing any backflow through the second outlet duct 32 into the container 14. As a result, the fluid can flow out of the container 14 through the first one-way valve 20 and be dispensed from the second outlet duct 32. After the fluid has been dispensed, it is impossible for contaminants, such as air, dust, gases or other materials to pass through the second outlet duct from the ambient atmosphere into the container.

In FIG. 6, there are two first branch ducts 29 and two second branch ducts 34. It would be possible to use only one or any convenient number of the branch ducts. Preferably, the branch ducts are arranged in a symmetrical manner to assure the efficient flow of the fluid from the first outlet duct 28 to the second outlet duct 32.

While O-ring seals 40 are shown holding the membrane 36 in sealed engagement with the valve body for preventing any flow of contaminants between the valve body and the membrane, other seals could be used. For instance, the membrane could be adhesively sealed to the valve body or held against the valve body in a variety of ways to assure the sealing action.

An annular flexible membrane 42 laterally encloses the first one-way valve 20 and forms a closure at one end of the support 12. The container 14 is secured at its outlet 18 to the elastic membrane 42. Accordingly, if the elastic membrane is pressed inwardly toward the container, it pressurizes the fluid causing it to flow into the first outlet duct 28 and through the one-way valve 20.

As the fluid flows out of the container 14, and the elastic membrane is released, it rebounds to the position shown in FIG. 2, since the interior of the container is free of any air. The atmospheric air acting on the end of the bag spaced from the outlet 18, causes the piston to move toward the outlet with the bag or container 14 being slowly collapsed with each dispensing charge. It is important that the lower end of the support 12 is open or has an opening for admitting atmospheric air into contact with the lower end of the bag so that due to differential pressure the piston 16 can ride upwardly toward the outlet 18 maintaining pressure on the fluid whereby it will continue to flow out of the container when the elastic membrane 42 is pressed towards the container 14.

Preferably, the support 12 is formed of a relatively hard material affording protection for the container 14. The support can be made of a plastics material, metal, glass or any other suitable material. If necessary, the support can be transparent providing an indication of the amount of fluid within the container 14.

Preferably, the elastic membrane 42 is formed of rubber or a rubber-like material so that it can be easily depressed against the container for dispensing the fluid and then rebound to its original shape when the pressing action is released.

Figure 5:
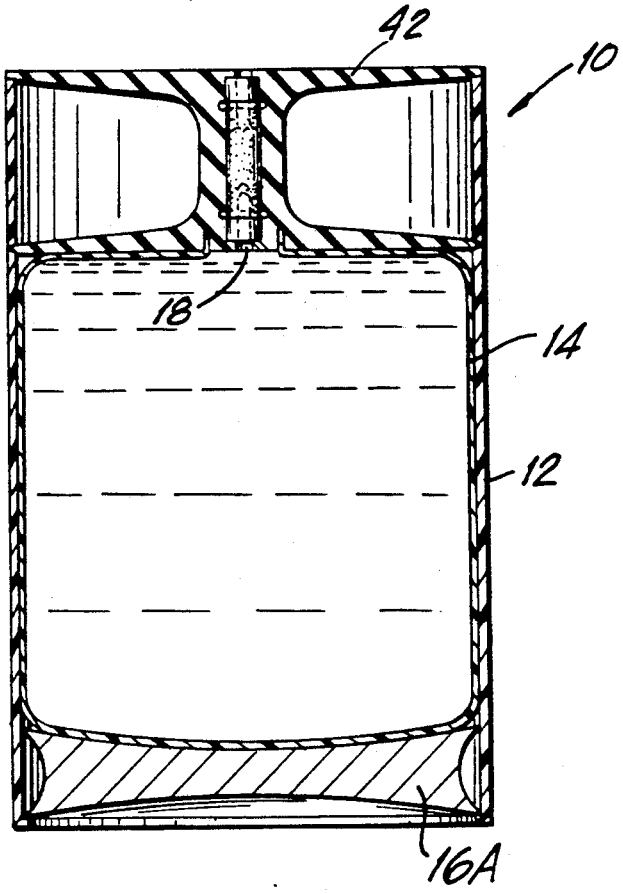
FIG. 5 is a sectional view, similar to FIG. 2, illustrating another embodiment of the device.

In FIG. 5, the dispensing device 10 is similar to the device shown in FIG. 1 and the same reference numerals are used except for the piston 16A. In this Figure, the piston 16A is located outside of the container 14 and rides toward the container outlet 18 along the surface of the support. The support 12 is open at the bottom so that the atmosphere contacts the piston and causes it to ride upwardly through the support 12 as the fluid is dispensed from the container 14.

To assure that the container 14, usually in the form of a flexible bag, is moved effectively and does not block the outlet 18, the container is attached to the piston 16A.

The dispensing operation of the device 10 in FIG. 5 is the same as in FIGS. 1 and 2.

In FIGS. 7, 8, 9 and 10, are shown different embodiments of the piston and of the elastic membrane which compresses the container for discharging fluid. In these embodiments, the devices are shown somewhat schematically, without a detailed illustration of the one-way valve 20. Like parts of the device have the same reference numerals as shown in FIGS. 1–4, however, with the addition of a prefix numeral.

Figure 7:
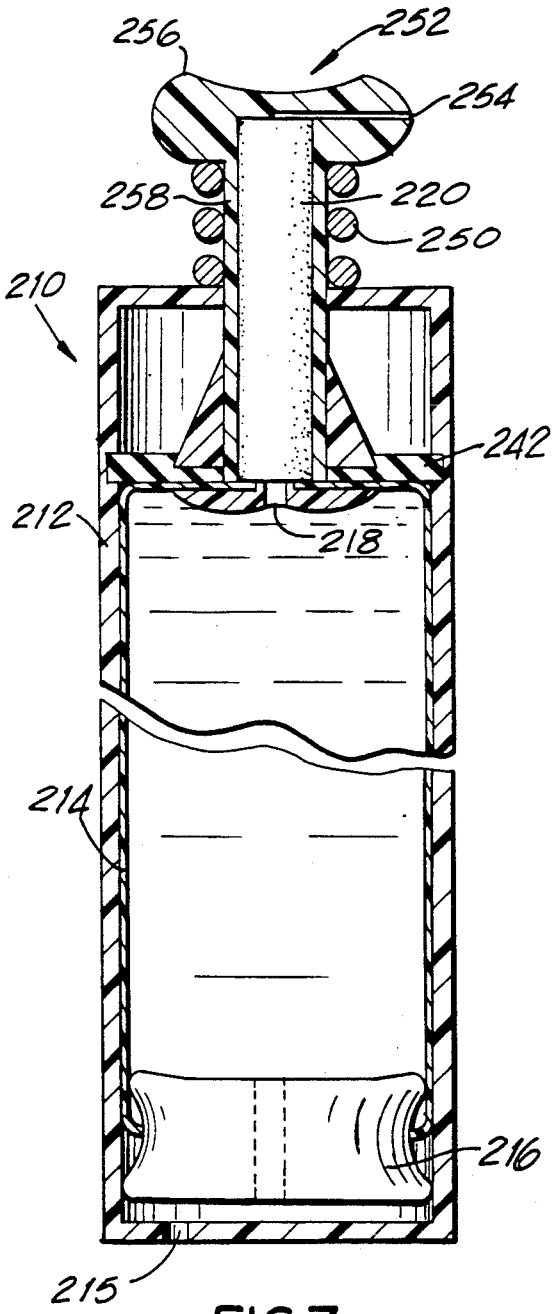

In FIG. 7, the dispensing device 210 includes a generally cylindrically shaped support 212 laterally enclosing the container or flexible bag 214 and having a vent hole 215 in the bottom of the support. The container 214 has a piston 216 secured to the lower end of the container, that is, the end spaced from the container outlet 218 connected to the inlet end of the one-way valve 220. The support extends upwardly above the container outlet 218, laterally enclosing an axially extending part of an applicator cap 252 having an outlet 254 connected to the outlet from the one-way valve 220.

Applicator cap 252 has a head 256 projecting laterally outwardly from a tubular section 258 extending from the head to the elastic membrane 242. The tubular section 258 encloses the one-way valve 220.

The lower end of the tubular section 258 is secured to the membrane 242 so that it can press the membrane downwardly against the container 218 for discharging fluid out of the container into the one-way valve 220 and finally out of the outlet 254 of the applicator cap. At its upper end, the support 212 extends inwardly towards the tubular section 258. The tubular section 258 is movable relative to the support so that it can depress the membrane 242. Spring 250 encircles the tubular section 258 between the lower side of the head 256 and the upper end of the support 12. Accordingly, when the applicator cap is pushed downwardly and released, the spring 250 will act in combination with the membrane 242 to return the applicator cap to the position shown in FIG. 7.

The piston 216 is secured to the end of the container 214 opposite the container outlet 218. As fluid is dispensed out of the device 210, atmospheric pressure present in the lower end of the support 212, due to the vent hole 215, acts on the piston 216 and will cause the piston to move toward the container outlet 218 based on the amount of fluid dispensed out of the container 214. As the piston 216 moves stepwise upwardly toward the container outlet 218, it moves relative to the inside surface of the container 214. The container will collect in the annular concave section of the piston 216 as it moves upwardly.

When the piston 216 reaches the upper end of the container, at the container outlet 218, substantially all of the fluid will have been dispensed.

Fluid can be introduced into the container 214 through a sealable opening through the piston.

In FIG. 8, the dispensing device 310 is the same as the device 210 in FIG. 7, however, there is the difference that the piston 316 located within the container 314 does not form the lower part of the container, but is secured to it at the point 319. Accordingly, when the applicator cap 352 is pressed downwardly against the biasing action of the spring 350, the membrane 342 attached to the cap compresses the container 314 so that its fluid contents exit through the outlet 318 and pass through the one-way valve 320. After the fluid flows out of the valve, the applicator cap 352 and the elastic membrane 342 rebound into the position shown in FIG. 8, due to the flow of atmospheric air through the vent hole 315, the bottom of the container and the piston 316 will ride upwardly within the container toward the outlet 318. Since the piston 316 is free of the container except at the point 319, it will ride upwardly toward the outlet 318 with the emptied part of the container trailing along with the piston. When the piston 316 reaches the container outlet 318, the major portion of the container will be below the lower side of the piston 316 within the support 312.

Similar to the embodiment in FIG. 7, fluid can be filled into the container 314 through a sealable opening.

Figure 9:
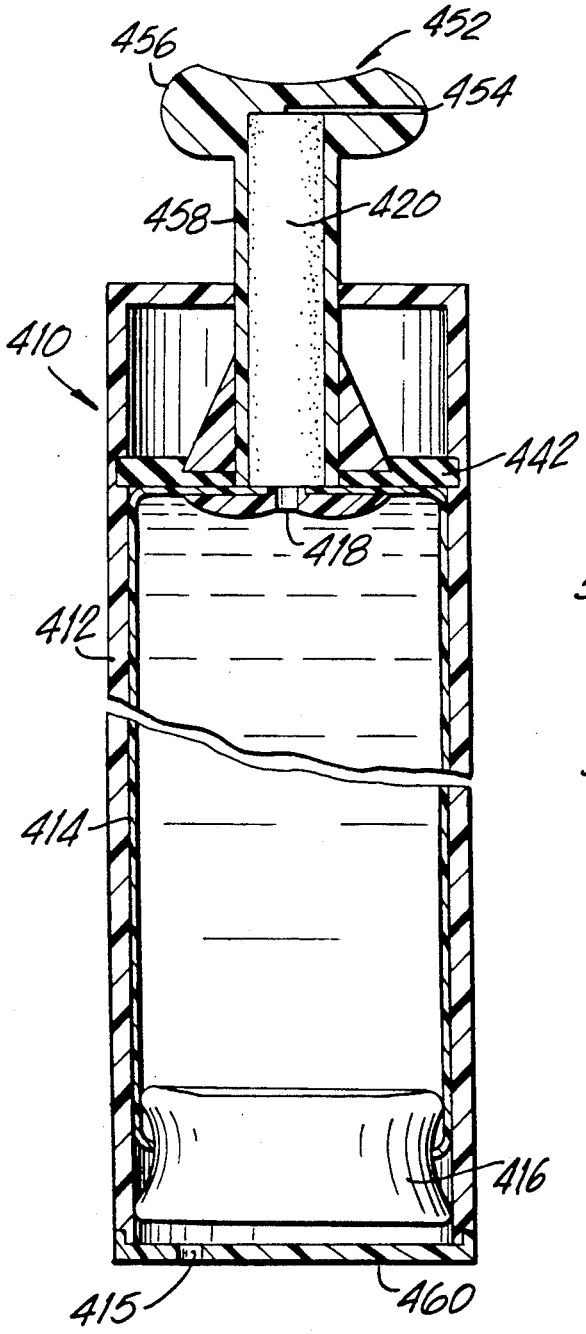

In FIG. 9, the dispensing device 410 is similar to that shown in FIGS. 7 and 8 with the following differences: the applicator cap 452 is not spring biased, the piston 416 is connected to the container 414 in the same manner as in FIG. 7, and the support 412 has a separable bottom 460 containing the vent hole 415.

Operation of the device 410 is the same as the device in FIG. 7, except that the applicator cap is not biased back into the position shown in FIG. 9 by a spring, instead it is returned only by the memory of the membrane 442.

Figure 10:
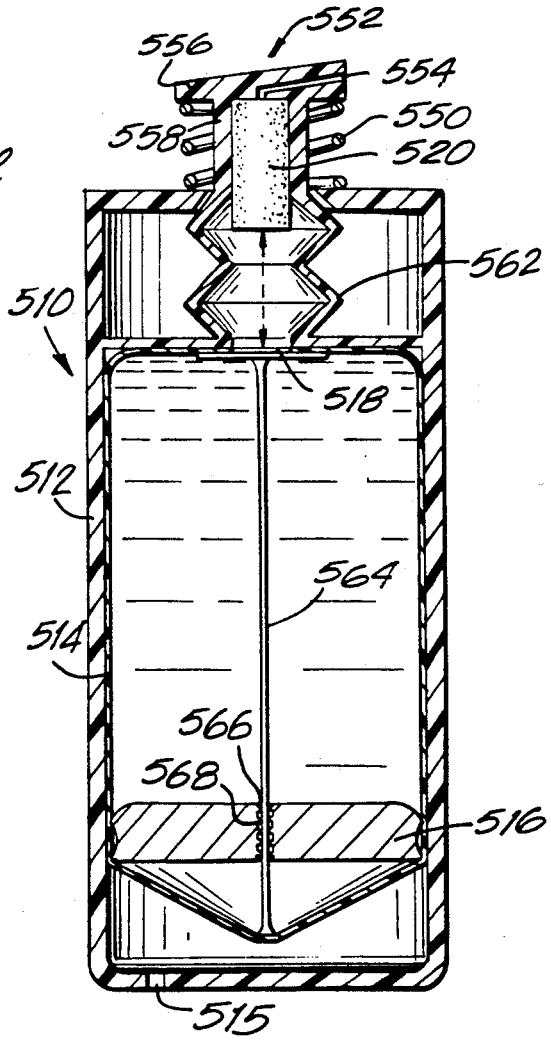

In FIG. 10, another dispensing device 510 is displayed generally similar to the embodiments in FIGS. 7, 8 and 9, however, with differences in the applicator cap 552 and in the arrangement of the piston 516.

In place of the elastic membrane 42, the applicator cap has a tubular section 558 extending downwardly from the head 556 for approximately half of the axial length of the cap with the lower half being formed as a bellows-like section 562 attached to the inside of the support 512. Accordingly, by pressing downwardly on the applicator cap 552, liquid is drawn upwardly into the interior of the bellow-like section 562 and then into the one-way valve 520 for flow out through the outlet 554.

The piston 516 is located within the container 514 and is free to move relative to the inside surface of the container. A rod 564 extends downwardly from the container outlet 518 to the base of the container 514. The rod 564 is held against upward movement, since it bears against the lower end of the support 512 to which the lower end of the bellow-like section 562 is attached.

The piston 516 is an annular member having a central opening 566 encircling the rod 564. Sawteeth 568 are formed in the inside of the opening 566 in the piston and engage the surface of the rod 564. As fluid is dispensed out of the container 514, atmospheric pressure causes the piston to move upwardly, the sawteeth 568 hold the piston in place on the rod so that the piston does not drop down within the container. Sawteeth 568 can be provided only on one side of the rod 564.

When the applicator cap is depressed for dispensing fluid out of the container 514, the combination of the rebounding action of the bellow-like section 562 and the spring 550 assure the return of the applicator cap 552 to the position shown in FIG. 10.

A significant feature of each of the embodiments described above is that the container is completely filled with the fluid to be dispensed and there is no air or other gas within the container. It is also important that the support has an opening or is open ended permitting atmospheric pressure to act on the container or piston as the fluid is dispensed so that the container can be collapsed and substantially all of the fluid dispensed.

While specific embodiments of the invention have been shown and described in detail to illustrate the application of the inventive principles, it will be understood that the invention may be embodied otherwise without departing from such principles.

We claim:

1. A fluid dispensing unit, comprising means for forming a closed collapsible container for fluid to be dispensed with the container adapted to be free of gas when initially completely filled with fluid, said container having an outlet, valve means connected to the outlet of said container for dispensing fluid out of the container and preventing any backflow into the container, means for applying pressure to the closed container for displacing the fluid out of the container, and means for collapsing the container as fluid is dispensed for substantially completely emptying the container, a rigid support at least laterally encloses said container, said support has an opening for admitting atmopsheric pressure into contact with at leastone of said container and said means for collapsing said container so that the atmospheric pressure and said means for collapsing the container effect the collpase of the container as fluid is dispensed from the container.

2. The fluid dispensing unit, as set forth in claim 1, wherein said valve means comrpises a valve body, a first oulet duct extending through said valve body, a second outlet duct extending through said valve body and spaced from said first outlet duct, a flexible first membrane laterally enclosing an outside surface of said valve body with each of said first outlet duct and second outlet duct opening from said valve body to an inside surface of said flexible first membrane, means for sealing said flexible first membrane to said valve body, said flexible first membrane being expandable by fluid pressed out of the container so that the fluid flows first through the first outlet duct to a space between the valve body and the flexible membrane and then through the second outlet duct to the ambient atmosphere.

3. The fluid dispensing unit, as set forth in claim 2, wherein said means for applying pressure to the closed container comprises an elastic second membrane mounted on said support, said container connected to said second elastic membrane, said elastic second membrane being displaceable against said container for compressing said container and forcing fluid therein through said container outlet into said valve body for flow therethrough.

4. Fluid dispensing unit, as set forth in claim 3, wherein said elastic second membrane comprises an annular member laterally enclosing said valve body and forming a closure for an end of said support for closing said support at said end.

5. The fluid dispensing unit, as set forth in claim 3, wherein said support has a hollow interior with a first end adjacent said container outlet and a second end spaced therefrom, said means for collapsing the container is a member slidably mounted within said support for movement from the second end toward the first end against said container, said member being exposed to atmospheric pressure for moving said member against said container toward the first end of said support.

6. The fluid dispensing unit, as set forth in claim 5, wherein said container is a flexible bag.

7. The A fluid dispensing unit, as set forth in claim 6, wherein said flexible bag is impermeable.

8. The fluid dispensing unit, as set forth in claim 5, wherein said support has a bellows-like section.

9. The fluid dispensing unit, as set forth in claim 5, wherein said member is a piston located within said support exteriorly f and in contact with said container.

10. The fluid dispensing unit, as set forth in claim 5, wherein said member is a piston located within said container at an end thereof remote from said container outlet for movement within the container toward said container outlet.

11. The fluid dispensing unit, as set forth in claim 5, wherein said support is open at said second end.

12. The fluid dispensing unit, as set forth in claim 3, wherein said support has a first end adjacent said container outlet and a second end spaced outwardly from said container outlet, said support is closed at the second end thereof, and has an opening in the second end of said support for admitting atmospheric pressure into said support.

13. The fluid dispensing unit, as set forth in claim 1, wherein said means for collapsing said container comprises a piston associated with said container and displaceable toward said container outlet for emptying the container.

14. The fluid dispensing unit, as set forth in claim 13, wherein said piston is located within said support exteriorly of and in contact with said container and is displaceable relative to said support toward said container outlet.

15. The fluid dispensing unit, as set forth in claim 13, wherein said piston is located within said container and is displaceable therein toward said container outlet.

16. The fluid dispensing unit, as set forth in claim 13, wherein said piston is connected to said container at an end thereof remote from said container outlet when said container is filled and is displaceable within said container toward said container outlet.

17. The fluid dispensing unit, as set forth in claim 17, wherein a rod is located within said container from said container outlet to an opposite end of said container, and said piston is an annular piston encircling said rod and located adjacent the opposite end of said container when the container is filled and is displaceable along said rod toward said container outlet.

18. The fluid dispensing unit, as set forth in claim 17, wherein said annular piston has an opening receiving said rod, said opening in said piston having sawtooth shaped teeth in engagement with said rod permitting said piston to move towards the container outlet and preventing movement of said annular piston away from said container outlet.

* * * * *